United States Patent [19]

Laing et al.

[11] Patent Number: 4,512,057

[45] Date of Patent: Apr. 23, 1985

[54] FLOOR CARE APPLIANCE

[75] Inventors: Gordon E. Laing; Martin E. Harbeck, both of Anderson; John E. Jones, Greenville; William R. Sumerau, Easley; William K. Glenn, III, Anderson, all of S.C.

[73] Assignee: The Singer Company, Stamford, Conn.

[21] Appl. No.: 605,043

[22] Filed: Apr. 30, 1984

[51] Int. Cl.[3] ..... A47L 5/30

[52] U.S. Cl. ..... 15/320; 15/328; 15/347; 15/350; 15/412; 15/413

[58] Field of Search ..... 15/328, 320, 350, 351, 15/413, 347, 412

[56] References Cited

U.S. PATENT DOCUMENTS

| | | | |
|---|---|---|---|
| 2,633,596 | 4/1953 | Turner et al. | 15/413 X |
| 3,218,783 | 11/1965 | Ripple | 15/350 X |
| 3,273,194 | 9/1966 | Jepson et al. | 15/350 X |
| 3,273,195 | 9/1966 | Jepson et al. . | |
| 3,634,905 | 1/1972 | Boyd . | |
| 3,675,268 | 7/1972 | Nordeen | 15/350 |
| 4,245,371 | 1/1984 | Satterfield . | |
| 4,447,930 | 5/1984 | Glenn et al. . | |
| 4,457,042 | 7/1984 | Jones et al. . | |
| 4,462,137 | 7/1984 | Berfield et al. | 15/413 X |

*Primary Examiner*—Chris K. Moore

*Attorney, Agent, or Firm*—Edward P. Schmidt; Robert E. Smith; Edward L. Bell

[57] ABSTRACT

A floor care appliance having a main housing with a handle extending from an upper portion thereof, and having a motor blower assembly affixed thereto with an inlet tube extending from a lower portion thereof. The main housing is fashioned with a rearwardly open cavity portion for receiving a filter arrangement including a paper filter bag having connection to an outlet tube of the motor blower assembly, and a second stage of filtration implemented by an air permeable closure covering the rearwardly open cavity portion. A floor unit carries a brush actuated by a reversible motor, a dry chemical carpet cleaning powder receptacle and dispensing arrangement for selectively dispensing the powder adjacent the brush, and a plenum chamber extending from adjacent the brush to a swivel having an outlet tube connected and affixed to the inlet tube of the motor blower assembly. A switch assembly is carried by a cover for the main housing and provides for operator selection of one of several modes of operation. A switch device is also provided to selectively actuate the dispensing arrangement during a specific one of the several modes.

3 Claims, 14 Drawing Figures

FLOOR CARE APPLIANCE

DESCRIPTION

BACKGROUND OF THE INVENTION

This invention relates to a floor care appliance; more particularly, to such an appliance used as a vacuum cleaner for removal of loose dirt, selectively, from a bare floor or from a carpeted floor; or as a carpet cleaning appliance selectively dispensing a quantity of dry chemical carpet cleaner from a storage chamber, agitating the same into and about the carpet fibers for subsequent removal of the cleaner and soil from the carpet by reversion to operation as a carpeted floor vacuum cleaner.

In the prior art there is found the U.S. Pat. No. 4,245,371 of Satterfield which relates to a carpet scrubber having the capability for operation as a vacuum cleaner. However, this device was designed for commercial use in cleaning carpets where the dry chemical is dispensed upon the carpet, agitated into the carpet for cleaning purposes and removed from the carpet by use as a vacuum cleaner in the last step of a commercial large scale carpet cleaning operation. Further, the commercial nature of this device permitted its design for use by specialists, and operation thereof would be beyond the capabilities of most home users.

Also in the prior art are the U.S. Pat. Nos. 3,634,905 of Boyd and 3,273,195 of Jepson et al. These patents are concerned with the unique design for a vacuum cleaner and for a "stick vac", respectively. These patent disclose vacuum cleaners of a particular construction but having no other capability than to remove loose dirt from carpets.

What is required is a floor care appliance for a home which may be used, selectively, as a vacuum cleaner for removal of loose dirt from a bare floor, such as a kitchen; and as a vacuum cleaner for a carpeted floor; and further having the ability for dispensing a dry chemical carpet cleaner from a storage chamber onto said carpet for removal of spots thereon, with the spent chemical carpet cleaner and loosened soil or dirt being removed from the floor by using the appliance as a carpet vacuum cleaner.

SUMMARY OF THE INVENTION

The above desideratum are found in a floor care appliance having a main housing including rear and side panels with a substantial portion of the rear panel depressed to form a cavity having an inlet aperture on a bottom surface. A handle for directing the floor care appliance is fixed to the upper portion of the main housing. A filter assembly is received in the main housing in the cavity thereof, closing said rearwardly open cavity with an air permeable closure. The main housing is further formed with an internal groove beneath the rear panel depressed portion, the internal groove receiving a main housing motor blower baffle. A motor blower assembly is supported by the main housing below the depressed portion thereof, the motor blower assembly including an inlet tube extending below the main housing, and an outlet tube extending through the inlet aperture to the cavity. A main housing extension is provided for attachment to the bottom of the main housing, the main housing extension having side panels and a louvered rear panel. A cover is provided including integral front, top and side panels and having an internal grooved surface spaced from an end thereof. A cover motor blower baffle is captured in the internal groove in the cover, and the cover is affixed to the main housing and main housing extension with the motor blower baffles aligned to provide an inlet chamber for motor cooling air and an outlet chamber for the spent cooling air, which may escape through the rear louvered panel of the main housing extension. The inlet tube, situated internally of the main housing extension and the cover, is connected to a swivel fitting for transferring air flow from a plenum chamber of a floor unit. The floor unit includes a lower housing supporting a pair of rear wheels, a forwardly situated brush, a reversible first motor for selectively driving the brush in a selected direction, a plenum chamber opening up to a vacuum slot adjacent the brush and the carpet or floor, and the swivel fitting; and an upper housing having a chamber for retaining a supply of dry chemical carpet cleaning powder, a second motor, and means for selectively dispensing the same operatively connected to the second motor. The cover further includes a switch assembly for selecting operation of the motor blower assembly without operation of the first motor (bare floor cleaning), operation of the motor blower assembly with operation of the first motor (carpet cleaning), operation of the first motor in a reverse direction (carpet fiber agitation), and operation of the second motor while the first motor is being operated in a reverse direction (dispensing dry chemical carpet cleaner).

DESCRIPTION OF THE DRAWINGS

While the specification concludes with claims particularly pointing out and distinctly claiming the subject matter which is regarded as forming the present invention, it is believed that the invention will be better understood from the following detailed description when taken in conjunction with the annexed drawings wherein like reference characters are used for similar parts throughout the various views and which discloses, illustrates and shows a preferred embodiment or modification of the present invention and what is presently considered and believed to be the best mode of practicing the principles thereof and wherein:

Referring now to FIG. 1 there is shown a floor care appliance 20 having the floor unit 22 thereof shown in the extended position, and with internal portions shown in phantom. Thus the body 24 of the floor care appliance carries internally thereof a filter arrangement 26 of a construction further referred to below, and a motor blower assembly 28 also to be referred to in further detail below. At the upper end of the body 24 of the floor care appliance there is supported a switch assembly 30 for selection of the operating mode of the floor care appliance, and a handle 32 for direction of the floor care appliance. The handle 32 supports a dispenser button 34 which may be activated for dispensing of a dry chemical carpet cleaning material, as will be explained below. Power for the floor care appliance is obtained through line cord 36 which line cord may be connected to the house mains in the usual form for electrical appliances.

Figure 1:
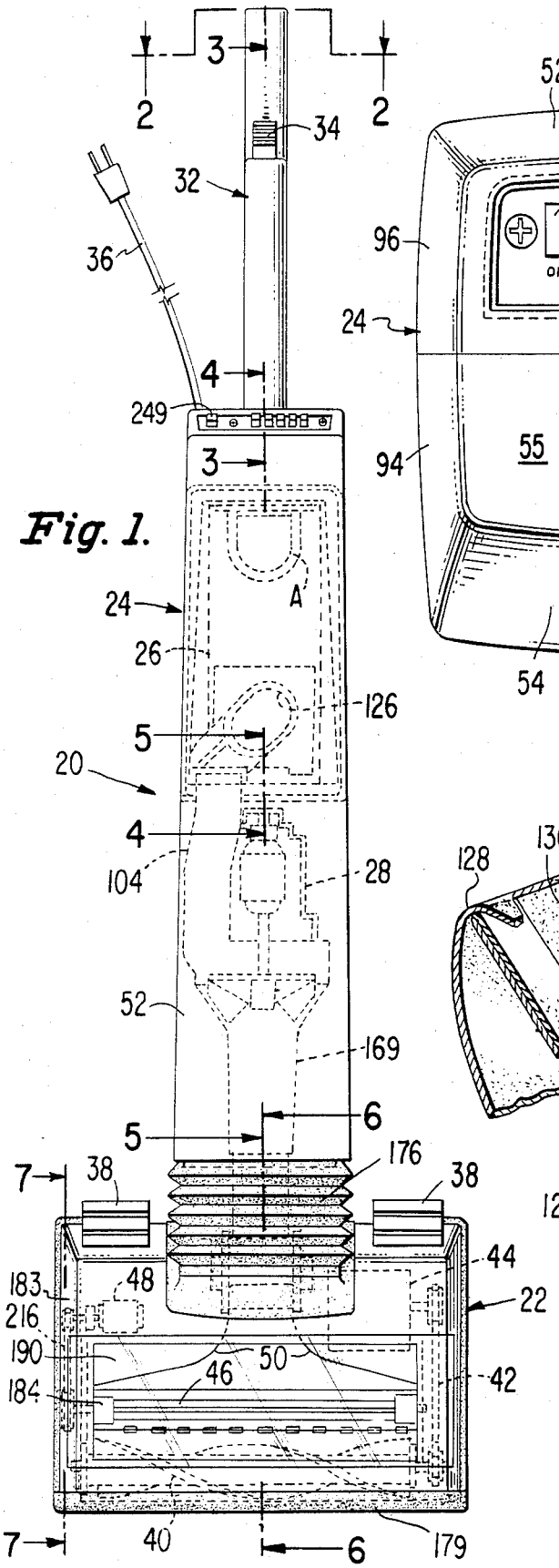
FIG. 1 is a front elevational view of the floor care appliance with the floor unit thereof swiveled to an extended position.

The floor unit 22 is fashioned with pedals 38 which may be manipulated in the usual fashion for floor care appliances to adjust the inclination of the body 24 of the floor care appliance with respect to the floor unit 22 thereof. Shown in phantom internally of the floor unit 22 is the floor brush assembly 40 connected by belt 42 to a first motor 44 which is a reversible motor. Also visible is a powder dispensing roll 46 which may be driven by a second motor 48 when activated by the dispenser button 34 in the handle 32. Further details on the above construction will be supplied below.

Figure 2:
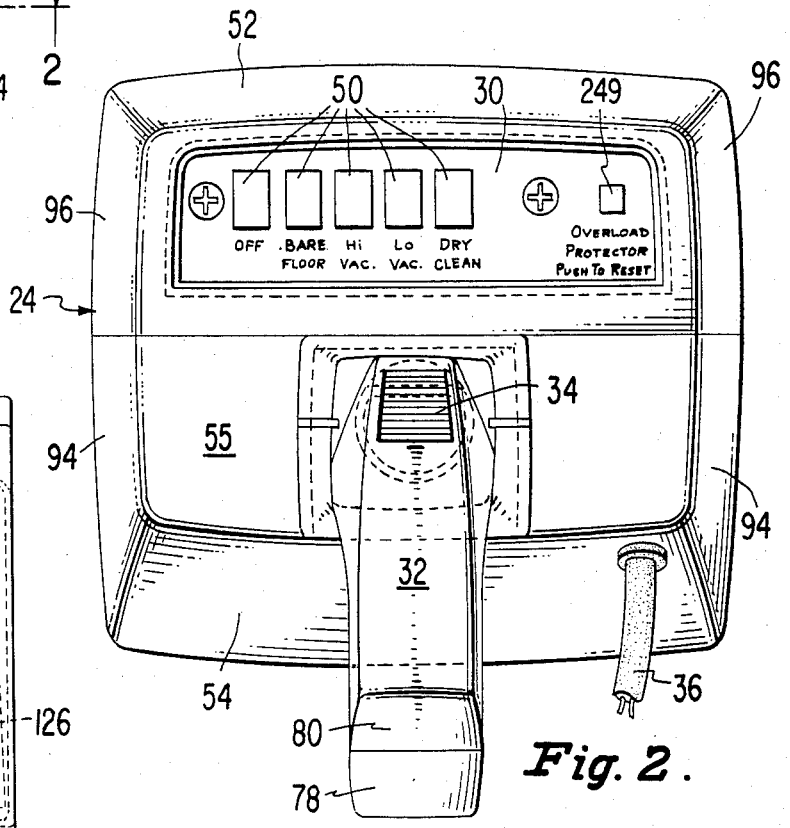
FIG. 2 is a top plan view of the handle and controls of the floor care appliance taken substantially along the line 2—2 of FIG. 1.

Referring now to FIG. 2, a top plan of the body 24 of the floor care appliance, the various modes of operation afforded by the switch assembly 30 are apparent. The switch assembly 30 provides five push-buttons 50 labeled, in turn, "Off", "Bare Floor", "Hi Vac", "Lo Vac", and "Dry Clean". The precise meaning for these terms and an electrical diagram indicating the switch hook-up will be described below; however, it may be stated that in bare floor mode of operation, the motor blower assembly 28 is operating but the floor brush assembly 40 in the floor unit 22 is not operating, whereas in the hi vac and lo vac modes, the floor brush assembly is operating in a direction to brush floor debris into a plenum chamber 50 visible in FIG. 1 with the motor blower assembly operating in a high, or low vacuum mode, respectively. In "Dry Clean" mode of operation, the floor brush assembly 40 revolves in the reverse direction away from the plenum chamber to agitate the dry chemical cleaning compound into the carpet fibers in order to aid in a thorough cleaning of the same. As indicated above, the dispenser button 34 in the handle 32 is activated to energize the powder dispensing roll 46 so that the dry chemical cleaning compound may be deposited upon the carpeted floor, as will be described below. In FIG. 2 it is also apparent that the body 24 of the floor care appliance includes an outer, cover half 52 which supports the switch assembly 30, and an inner, main housing half 54 to which the handle 32 is connected.

Figure 3:
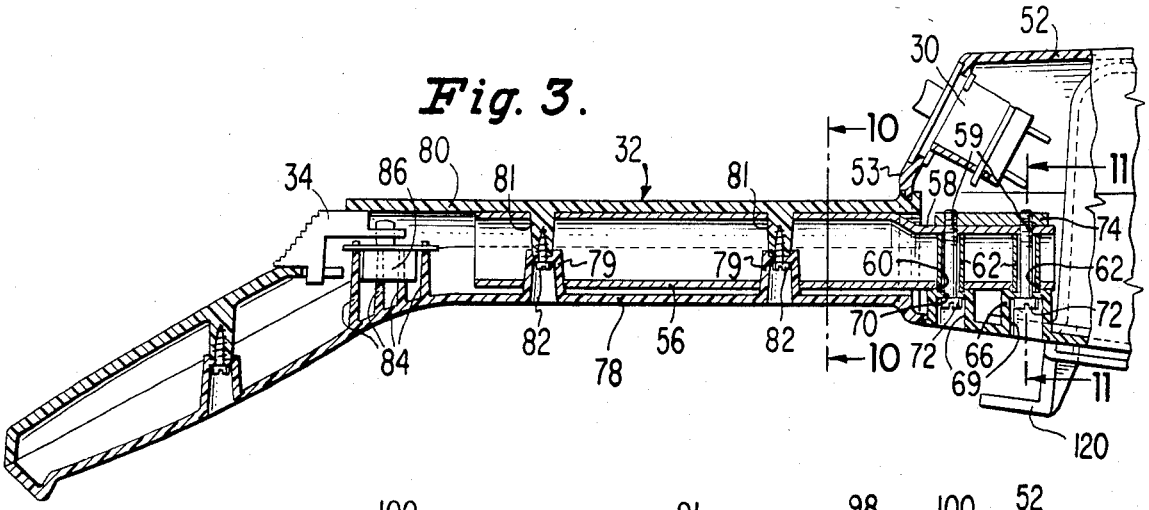
FIG. 3 is a cross-sectional view taken along the handle of the appliance substantially along the line 3—3 of FIG. 1.

Referring now to FIG. 3, there is disclosed a cross-section through the handle 32 taken substantially along the line 3—3 of FIG. 1. The handle 32 is seen to include a handle tube 56 having a flatted portion 58 on one end thereof to provide for a D-shaped cross-section (see FIG. 11). Apparent from a inspection of FIGS. 3 and 11, the flatted portion 58 of the handle tube 56 is formed with two small holes 59 on the center line of the flatted portion, spaced from each other, and axially aligned with two larger holes 60 through the circumference of the handle tube opposite the small holes. Reinforcement tubes 62 extend through the larger holes 60 and bear against the flatted portion 58 on the inside of the handle tube 56.

Figure 11:
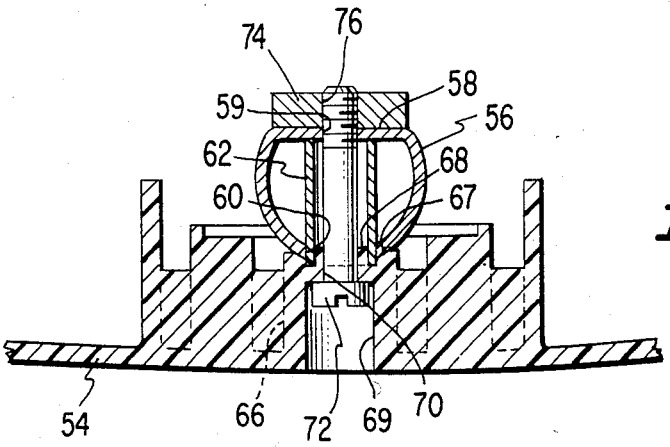
FIG. 11 is a second cross-sectional view of the handle taken substantially along the line 11—11 of FIG. 3.
Figure 10:
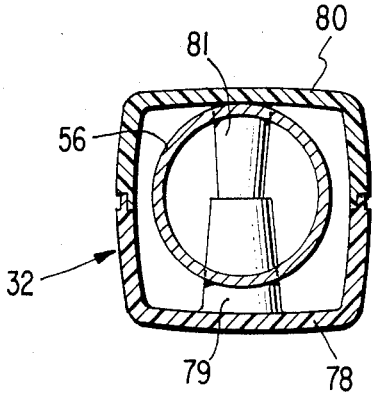
FIG. 10 is a cross-sectional view of the handle taken substantially along the line 10—10 of FIG. 3.

Further referring to FIGS. 3 and 11 it can be seen that the main housing 54 is formed with an opening 64 extending through the top wall 55 of the main housing. The handle tube 56 extends through this opening 64 and is seated on the curved upper surfaces 67 of a pair of bosses 66 extending inwardly from the rear surface of the main housing 54. The curved upper surfaces 67 of the bosses 66 are further formed with buttons 68 located centrally of the upper surfaces and designed to sit internally of the reinforcement tube 62 in order to insure the proper location of the same with respect to the curved upper surfaces 67. Each boss of the pair of bosses 66 is formed with a countersink 69 and a central aperture 70 which extends from the countersink through the buttons 68 on the curved upper surfaces 67 of bosses. A pair of screws 72 have the heads thereof retained in the countersink 69 of the bosses 66 with the threaded portions extended through the central apertures 70, through the central portion of the reinforcement tube 62 and through the smaller apertures 59 in the flatted portion 58 of the handle tube 56. A handle mounting plate 74 is provided having a pair of tapped holes 76 axially spaced to coincide with the spacing of the smaller apertures 59. The screws 72 are threaded into the tapped holes 76 in the handle mounting plate 74, thus clamping the handle tube 56 firmly to the main housing 54 in a connection in which the reinforcement tube 62 can extend between the handle tube and the main housing to prevent any collapse of the handle tube which would loosen the connection between the handle tube and the main housing. Additional apertures may be provided in the handle tube 56 to accommodate bosses 79 in a load half handle cover 78 and bosses 81 in a cover half handle cover 80, which covers may be fashioned from a synthetic resin material to provide a decorative covering for the handle tube 56. Screws 82 may be provided to extend through a countersinks in bosses 79 and into bosses 81 to thereby join the load half handle cover 78 to the cover half handle cover 80. Ribs 84 may be provided to support a momentary contact switch assembly 86 in a position to be actuated by the dispenser button 34 slidably supported in the cover half handle cover 80.

Figure 4:
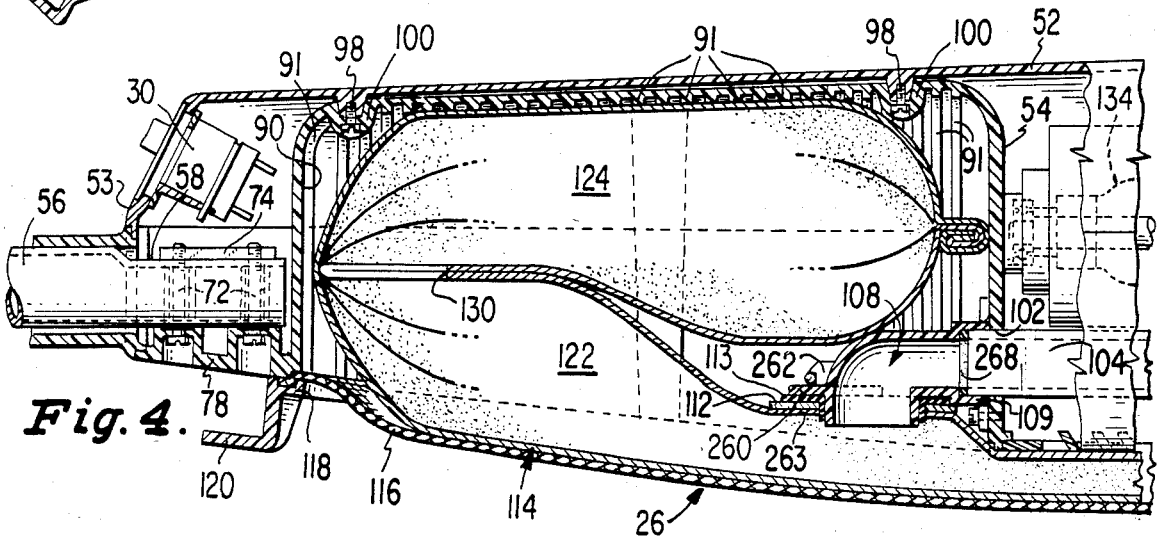
FIG. 4 is a cross-sectional view of the floor care appliance taken substantially along the line 4—4 of FIG. 1.

Referring now to FIG. 4, a cross-section taken substantially along the line 4—4 of FIG. 1, there is disclosed the upper half of the main housing 54 and cover half 52 thereof and the filter arrangement 26 carried therein. Visible in FIG. 4, and in FIG. 3 also, is the switch assembly 30 carried in the top 53 of the cover half 52. Also apparent is the construction of the main housing 54 including a large cavity 90 formed by depressing the rear surface 92 over the major portion of the main housing 54 between and beyond the side surfaces 94 thereof (see also FIG. 8). This cavity 90 is stiffened and strengthened by formation of ribs 91 on all internal surfaces. The cavity 90 thus formed abuts the internal front surface of the cover half 52 between the side walls 96 thereof (see also FIG. 8). Screws 98 (see also FIG. 8), one of which is shown in a break away, extend through apertures in raised dimples 100 on the rear surface of the cavity 90 and into bosses on the interal front surface of cover half 52 which are surrounded by the raised dimples so as to retain the cover half firmly to the main housing 54. The rearwardly open cavity 90 is further formed with an inlet aperture 102 through which a lower diffuser 104 from the motor blower unit 28 may extend. An upper diffuser 108 is fashioned with a bellend 109 which connects with the lower diffuser 104 to turn the air flow 90° to the inlet of the filter arrangement 26. The filter arrangement 26 includes a collar 112 of press board having a rubber dust seal 113 affixed to the outer side thereof and adhered to an air-permeable paper filter bag 114 on the other side thereof. This collar 112 is attached to the upper diffuser 108 to provide a dust tight air seal from the motor blower assembly 28 to the paper filter bag 114. The filter arrangement 26 is completed by a second stage of filteration by an air-permeable cloth 116 which covers the rearwardly open cavity 90 and is retained to the main housing 54 by a bag frame 118 affixed to the main housing by screws 119 (see also FIG. 8). The upper end of the bag frame 118 may be formed with a line cord cleat 120 as an aid to storage of the line cord 36.

Figure 13:
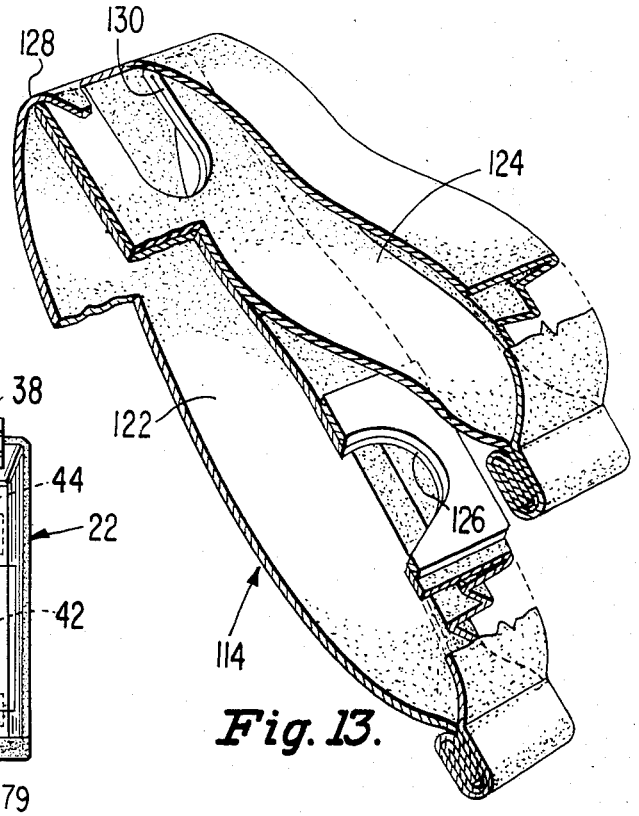
FIG. 13 is a sectional perspective of the filter bag showing details of construction thereof.

The paper filter bag 114 includes an inlet chamber 122 and a quiescent storage chamber 124. The paper filter bag 114 is intially fashioned as an elongate tubular member of filter paper sheet material with accordion pleated, expandable sides and with the ends folded and secured to define air impermeable seals (see also FIGS. 5 and 13). The elongated tubular member is provided with an inlet aperture 126 and is folded upon itself at 128, spaced from the inlet aperture, with confronting portions of the tubular member adjacent the fold being sealed together (as at A of FIG. 1) and including an opening 130 at the top of the inlet chamber 122, between the inlet chamber and the quiescent storage chamber 124. While the exact operation of filter bag 114 is not know, it is surmised that, in operation, the dust entrained by the air flow from the motor blower assemby 28 enters the inlet chamber 122 and is circulated therein by a continuing circular air flow until this dust is carried through the opening 130 into the quiescent storage chamber 124. Once the dust is in the quiescent storage chamber 124, it is no longer in the direct air flow from the motor blower assembly 28, and thus, remains there and is not available to fill the pores of the filter paper sheet material. Thus, for example, the dry chemical carpet cleaner, which has been found to lodge in the pores of the filter paper and rapidly seal the same to defeat the air permeability thereof, may be diverted to a quiescent area while entrained in the air stream so that it will no longer be available to fill up the pores in the filter material. Ideally, the inlet aperture 126 for the inlet chamber 122 is provided on the same side of the elongate tubular member as the opening 130, with the aperture and opening in longitudinal alignment, so that the circular air flow shown in FIG. 4 will operate efficiently to bring the heavier entrained dirt particles through the opening as the air flow is turning, and thus, into the quiescent storage chamber 124. A filter bag 114 fashioned along these lines has been found to be more effective than a larger single chamber bag. Ribs 91 in the cavity 90 do allow an airflow from the quiescent storage chamber 124 around to the cloth 116, but at a 50% restriction of the storage chamber porosity, when unused.

Figure 14:
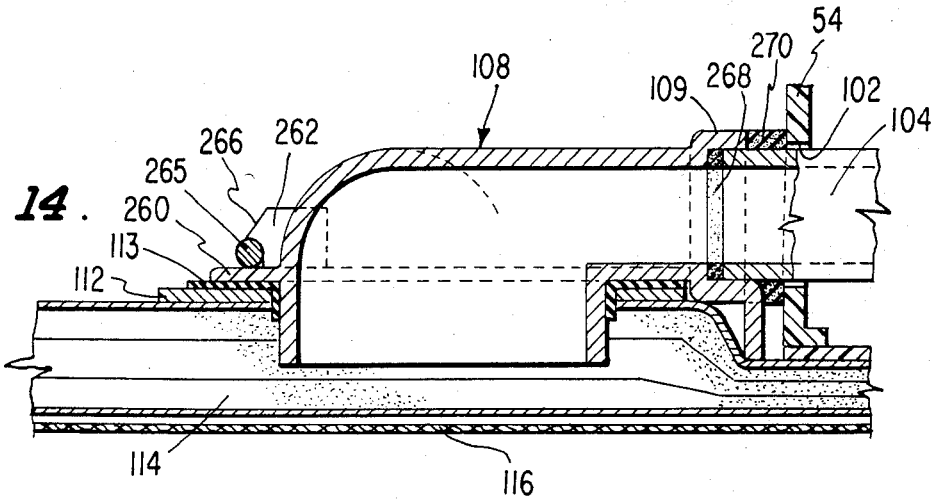
FIG. 14 is an enlarged cross sectional view of the connection to the filter bag.

The air permeable cloth 116 is provided with a zippered closure (not shown) which extends about a major portion of the periphery of the cavity 90 adjacent the bag frame 118. Convenient access to the paper filter bag 114 for replacement purpose is provided by opening of the zippered closure on the air permeable cloth 116. Removal of the paper filter bag 114 is facilitated by removal of the upper diffuser 108 therewith, this technique also serving to facilitate insertion of a replacement filter bag 114. The upper diffuser 108 is fashioned with an integrally molded backing plate 260 for the collar 112 and dust seal 113. Extending from the forward surface of the backing plate 260 are a pair of spaced ears 262 which are each fashioned with a notch 263 adjacent the forward surface to receive a rod 265 fixed between the sides of the cavity 90 (see FIG. 14). Each ear 262 is formed with a ramp 266 leading tc the notch 263 to assist in positioning the upper diffuser 108 as it is pressed into the position shown in FIG. 4. A resilient gasket or O ring 268 is provided between the upper diffuser 108 and the lower diffuser 104 to seal these tubes together and to provide sufficient "give" to enable the upper diffuser 108 to shift to enable the rod 265 to enter or leave notch 263 in response to pressure on the backing plate 260. Thusly, the filter bag 114 may be readily removed or replaced by pulling or pushing on the backing plate 260 of an upper diffuser already extending into the filter bag, as the bellend 109 of the upper diffuser is engaged with the lower diffuser 104. If, however, there is a concern that the upper diffuser 108 may inadvertently be discarded with a used paper filter bag 114, the upper diffuser may be fixed in position by any suitable means. Also visible in FIG. 14 is a gasket 270 positioned between upper diffuser 108 and rearwardly open cavity 90 to prevent ingestion of dust into the motor cooling air in the event of rupture of filter bag 114.

Figure 5:
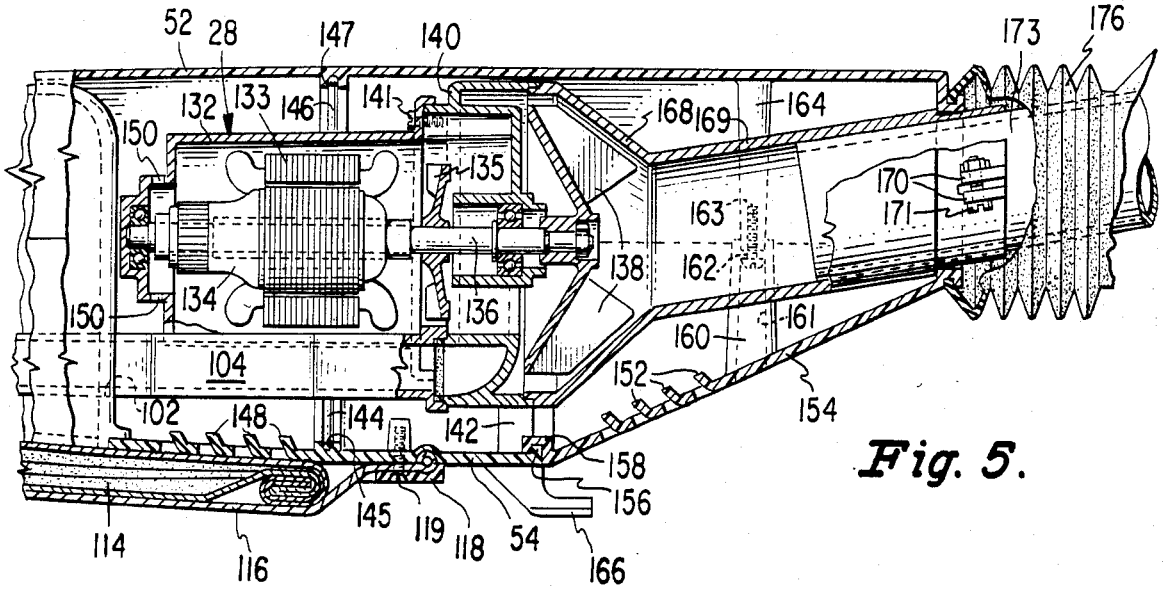
FIG. 5 is a cross-sectional view of the floor care appliance taken substantially along the line 5—5 of FIG. 1.

Referring now to FIG. 5, a cross-section taken along line 5—5 of FIG. 1, there is disclosed the motor blower assembly 28 and the support therefore by the main housing 54 and cover half 52. The motor blower assembly 28 includes a motor housing 132 which supports therein the field core 133 and armature assembly 134. The armature assembly 134 supports adjacent to the armature the cooling fan 135 for the motor assembly; and, on the end of the armature shaft 136 supports an axial-centrifugal fan-blower 138. The motor housing 132 is attached to a volute 140 by screws 141, only one of which is visible in FIG. 5. The volute 140 takes the output from the axial-centrifugal fan-blower 138, compresses the same, and outputs the compressed air into the lower diffuser 104 which, as indicated above, extends through inlet aperture 102 in the rearwardly open cavity 90 and through the upper diffuser 108 into the filter bag assembly 110.

Figure 8:
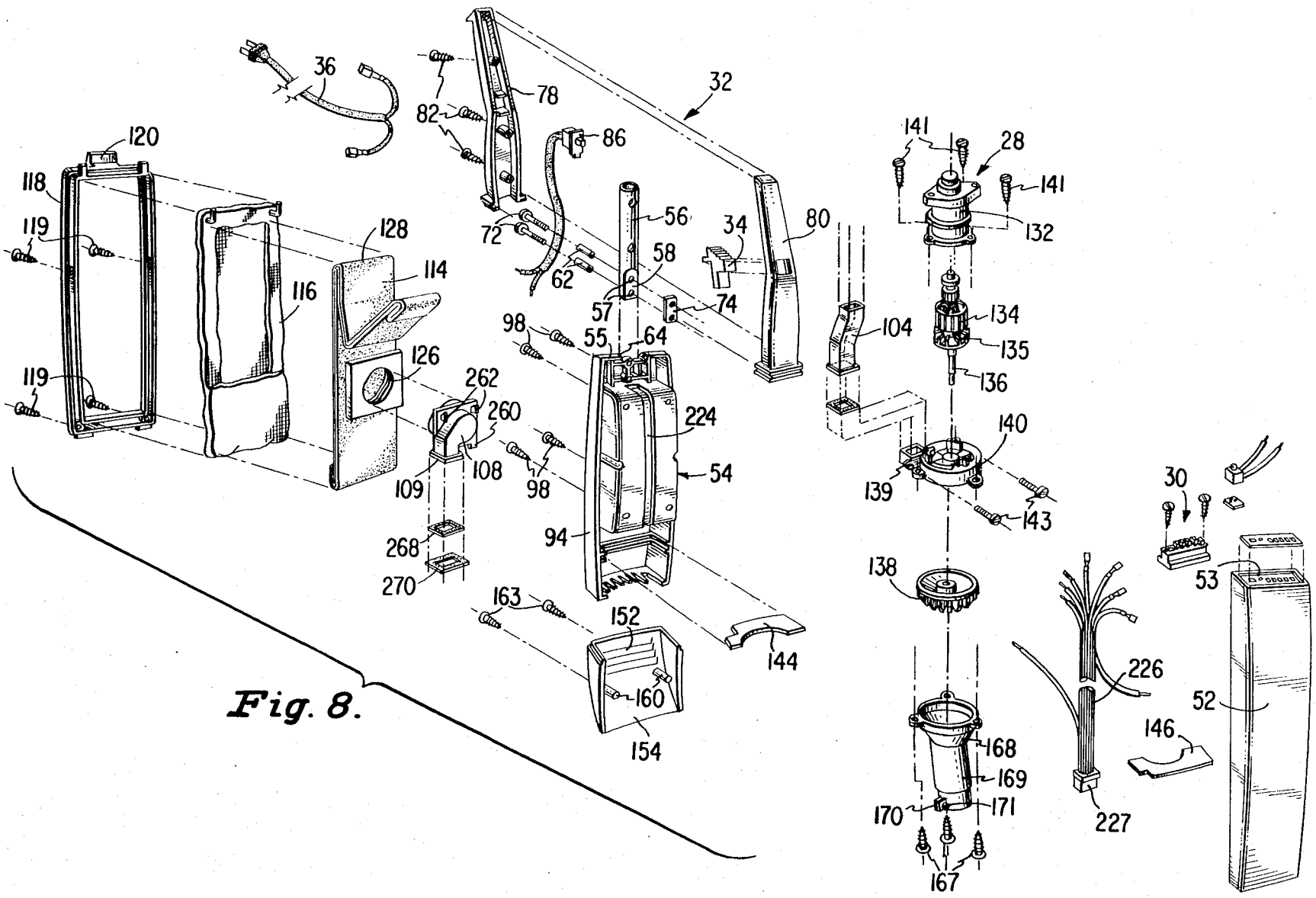
FIG. 8 is a exploded perspective of the body of a floor care appliance to shown the internal construction thereof.

The motor blower assembly 28 is supported by the main housing 54 through a pair of ears 139 (see FIG. 8) formed as part of the volute 140, which ears are attached to bosses 142, only one of which is shown in FIG. 5, by a screw 143 (see FIG. 8). A motor baffle 144 extends from a groove 145 formed as part of the main housing 54 and encircles the motor housing 132 to abut a cover baffle 146 also captured in a groove 147 of the cover 52 and encircling the motor housing. Thus, additional support is provided for the motor housing 132, centering the motor housing in the body 24 of the floor care appliance. However, the motor baffle 144 and cover baffle 146 also provide for separation for the motor cooling inlet air which enters through louvers 148, in the main housing 54 and is drawn into apertures 150 in the motor housing 132 by the cooling fan 135. Air drawn into the motor housing 132 by the cooling fan 135 is exhausted through circumferential apertures (not shown) in the volute 140 aligned with the cooling fan and into the discharge chamber provided by the motor baffle 144 and the cover baffle 146. Louvers 152 are provided in a main housing extension 154 attached to the main housing 54, on a ridge 156 thereof, by a lip 158 which encircles this ridge. Bosses 160 are provided on the main housing extension 154, which bosses each have countersink 161 and aperture 162 through which screw 163 may extend to be received in a boss 164 formed as part of the cover half 52. Thus, by removal of four screws 98 from the rearwardly open cavity 90, and two screws 163 from the main housing extension 154, the cover half 52 may be removed, and the motor blower assembly might be removed by removal of the screws 143 one of which enters into the boss 142 of the main housing 54. Also apparent in FIG. 5 is a lower line cord cleat 166 formed as part of the main housing 54, which provides with the upper line cord cleat 120 storage for the line cord 36 supplied with the floor care appliance 20.

The motor blower assembly 28 further includes a cone 168 which fits closely about the axial-centrifugal fan-blower 138 for increased efficiency thereof and attaches to the volute 140 by screws 167 (see FIG. 8). The cone 168 includes as part thereof, an inlet tube 169 which, on one end, opens up to the cone and the other end extends beyond a lower portion of the main housing between the cover half 52 and main housing extension 154 so as to encircle the outlet tube of a swivel 172, part of floor unit 22, and most readily visible in FIGS. 6 and 7. The outlet tube of the swivel 172 is fashioned with a fin 174 which, as the outlet tube is encircled by the inlet tube 169 of the cone 168, slides into a slot in the edge of the inlet tube, so as to bring the fin of the swivel between a pair of lugs 170 at the end of the inlet tube 169; and a screw and a nut 171 are provided to extend through aligned apertures in the lugs 170 and fin 174 so that the body 24 of the floor care appliance and the floor unit 22 may be joined together. A bellows 176 is provided to extend between the body 24 of the floor care unit and the floor unit 22 so as to provide for flexibility therebetween and to conceal the functional components and electrical connections extending between the body and the floor unit (see also FIG. 1).

Figure 6:
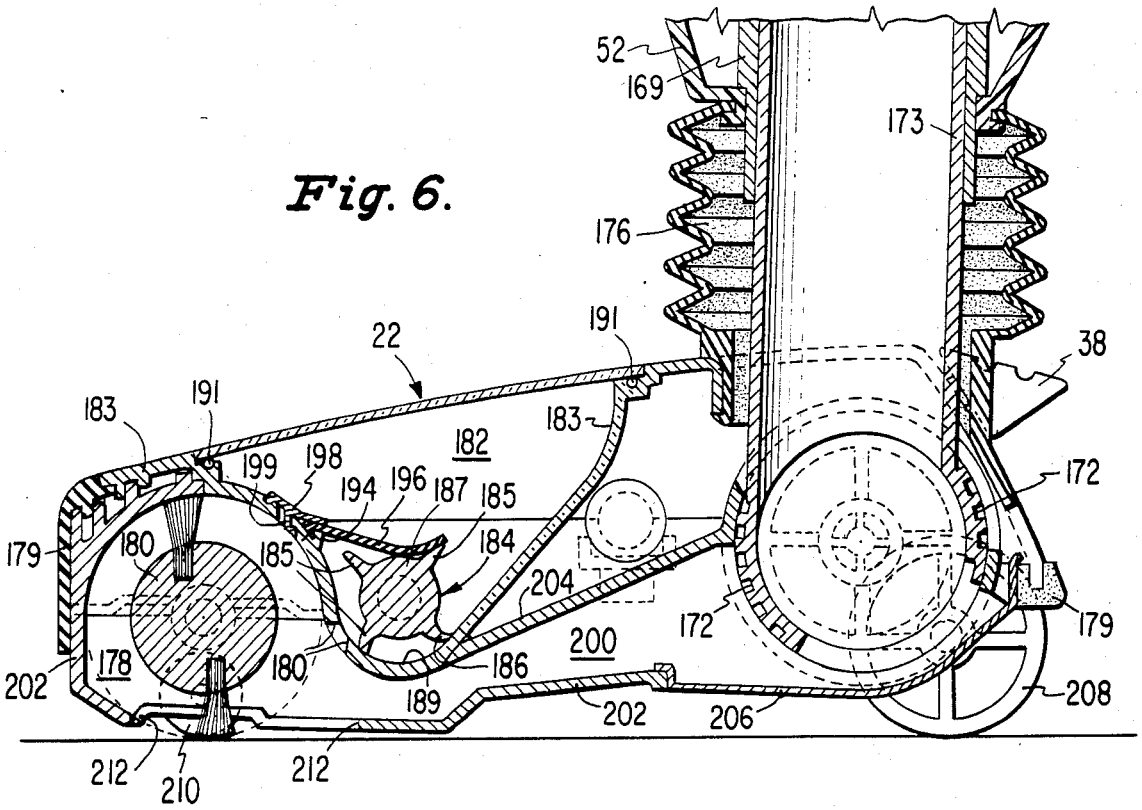
FIG. 6 is a cross-sectional view of the floor unit taken along the line 6—6 of FIG. 1 with the swivel thereof, however, shown in the stored position for the unit.

Referring now to FIG. 6, a cross-section taken substantially along the line 6—6 of FIG. 1, so as to indicate the internal details of the floor unit 22, there is visible the bellows 176 extending from the cover 52 and the main housing extension 154 around the inlet tube 169 and the outlet tube 173 of the swivel 172. In the forward portion of the floor unit 22 there is located a brush chamber 178 implemented by a brush housing 179 in which is situated a brush 180 having, in this embodiment, two bristles. Immediately adjacent the brush chamber 178 is located a powder retaining chamber 182 implemented by an upper housing 183 and for receiving the dry chemical carpet cleaning material which may be a synthetic polymer formulated into spongelike porous particles and carrying a cleaning agent or solvent for a moisture content of approximately 40% to facilitate release of dirt particles from the carpet fibers. Such a dry chemical carpet cleaning material is known to agglomerate or cohere together in clumps, requiring some means to break up these clumps to facilitate dispensing of the same. For this purpose, a powder dispensing roll 184 is provided at the circular bottom wall 189 of the powder retaining chamber 182, which roll may be implemented by a member having three vanes 185 long enough to contact the circular bottom wall when situated beneath the roll, and a fourth vane 186 approximately 0.050 inch larger to provide for a cleaning function aiding in dispensing of the dry chemical carpet cleaning powder. The powder dispensing roll 184 is manufactured from a synthetic resin material with the body 187 thereof at a hardness of approximately 90 durometer. The vanes, however, are simultaneously manufactured with a durometer of 40 so as to exhibit considerably more resilience. Slots 188 are provided in the powder retaining chamber 182 immediately adjacent the brush 180, so that powder might be disseminated immediately behind the brush. As the larger vane 186 of the powder dispensing roll 184 comes upon the slot 188, the resilient action and shock of this long vane abruptly projecting into the slot and being drawn across the trailing edge of the slot will set up a vibration and wipe to agitate free any agglomerated dry chemical carpet cleaning material bridging the slot so that the remaining three vanes may convey additional material to the slots which would thereby be opened to allow passage of this material therethrough. Thus, every revolution of the powder dispensing roll 184 operates to clean the slots 188 of agglomerated carpet cleaning material.

A transparent cover 190 is provided for the powder retaining chamber 182, through which cover the powder supply might be replenished as necessary (see also FIG. 1). The cover 190, installed on the upper housing 183 rests upon an O-ring 191 retained by the upper housing 183 on the periphery of the opening to the powder retaining chamber 182. Thus, the dry chemical carpet cleaning material stored in the powder retaining chamber 182 is protected from evaporation of the solvents retained thereby through the cover 190. In the powder retaining chamber 182, adjacent the front of the powder dispensing roll 184 the upper housing 183 is formed with an upstanding lip 194 extending the width of the powder retaining chamber. A soft resilient seal 196 is provided having an edge 197 extending normally to the body of the seal and inserted adjacent the upstanding lip 194 in the powder retaining chamber 182 so that the body of the seal overhangs the powder dispensing roll 184. A seal retainer 198 is formed with lugs 199 that extend through apertures therefor in the powder retaining chamber 182 so that the seal retainer presses against the soft resilient seal 196 to retain the same in a position in constant engagement with the powder dispensing roll 184 or the vanes 185, 186 thereof. Thus, the contents of the powder retaining chamber 182 are sealed from exposure to the ambient by way of slots 188 by the vanes 185, 186 of the powder dispensing roll 184, in engagement with the circular bottom wall 189 of the upper housing 183 on one side of the slots 188 and by engagement of the soft resilient seal 196 with the vanes 185, 186 or powder dispensing roll 184 on the other side of the slots 188. In this fashion, evaporation of the solvents carried by the dry chemical carpet cleaning material is inhibited, so that a supply of dry chemical carpet cleaning material may be usably retained in the powder retaining chamber 182 between periods of use for the floor care appliance 20. The resilient seal 196 also reacts to rotation of the powder dispensing roll 184, and the slapping of vanes 185, 186 thereupon, to set up a vibration or resonance which will aid in breaking up coherent particles in the powder retaining chamber 182 to help in feeding the carpet cleaning powder retained therein to the powder dispensing roll.

Extending from the brush chamber 178 beneath the powder chamber 182 and into the swivel 172 connecting the floor unit 22 to the motor blower assembly 106, is a vacuum chamber 200 implemented by a lower housing 202 and swivel retainer and support 204. The vacuum chamber 200 is discontinuous as at 212 beneath the brush 180 and slightly rearwardly thereof to provide access for dirt laden air to the vacuum chamber and to allow powder to be dispensed from the powder retaining chamber 182 to a carpet. An access port 206 is provided through which large ingested objects may be removed, if necessary. The floor unit 22 is supported on the brush 180 and on rear wheels 208, which revolve freely on an operators urging of the power unit 22. A pair of front wheels 210 are provided on either side of the brush 180 which project from the lower housing 202 approximately 0.020 inch below the lowest surface thereof, these wheels being provided primarily to prevent a vacuum seal which would occur if the discontinuity 212 is pressed against the carpet by flexure of the fibers of the brush 180. The brush 180 revolves counterclockwise as viewed in FIG. 6 in the vacuum mode of operation, and the dirt vibrated and brushed from the carpet fibers by the brush is directed by the air stream passing through the discontinuity 212 into the vacuum chamber 200 and through the swivel 172 to the inlet tube 169 of the motor blower assembly 28. In the carpet clean mode of operation, as indicated above, the motor blower assembly 28 is shut-off and the brush 180 revolves in a clockwise direction, to agitate the dry carpet cleaning material in and amoung the carpet fibers for thorough removal of dirt therefrom. The off-set nature of the bristles 181 of the brush 180 insures that in clockwise rotation as viewed in FIG. 6, the bristles 181 will exhibit more resistance to flexing and there will be a greater working of the dry carpet cleaning material in any among the carpet fibers.

Figure 7:
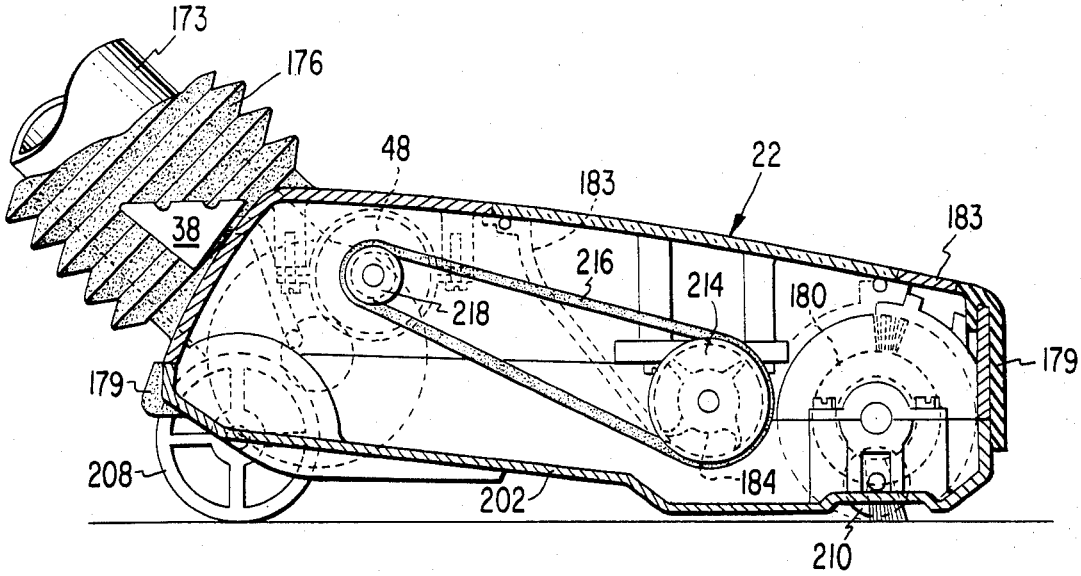
FIG. 7 is a cross-sectional view of the floor unit taken along the line 7—7 of FIG. 1.

In FIG. 7, a view taken substantially along the line 7—7 of FIG. 1, there is shown the drive for the powder dispensing roll 184 which includes a pulley wheel 214 fastened to the end thereof. A belt 216 connects the pulley wheel 214 to a second pulley wheel 218 carried on the shaft of the second motor 48 which is affixed to bosses 220 of the upper housing 183 by screws 221.

Figure 9:
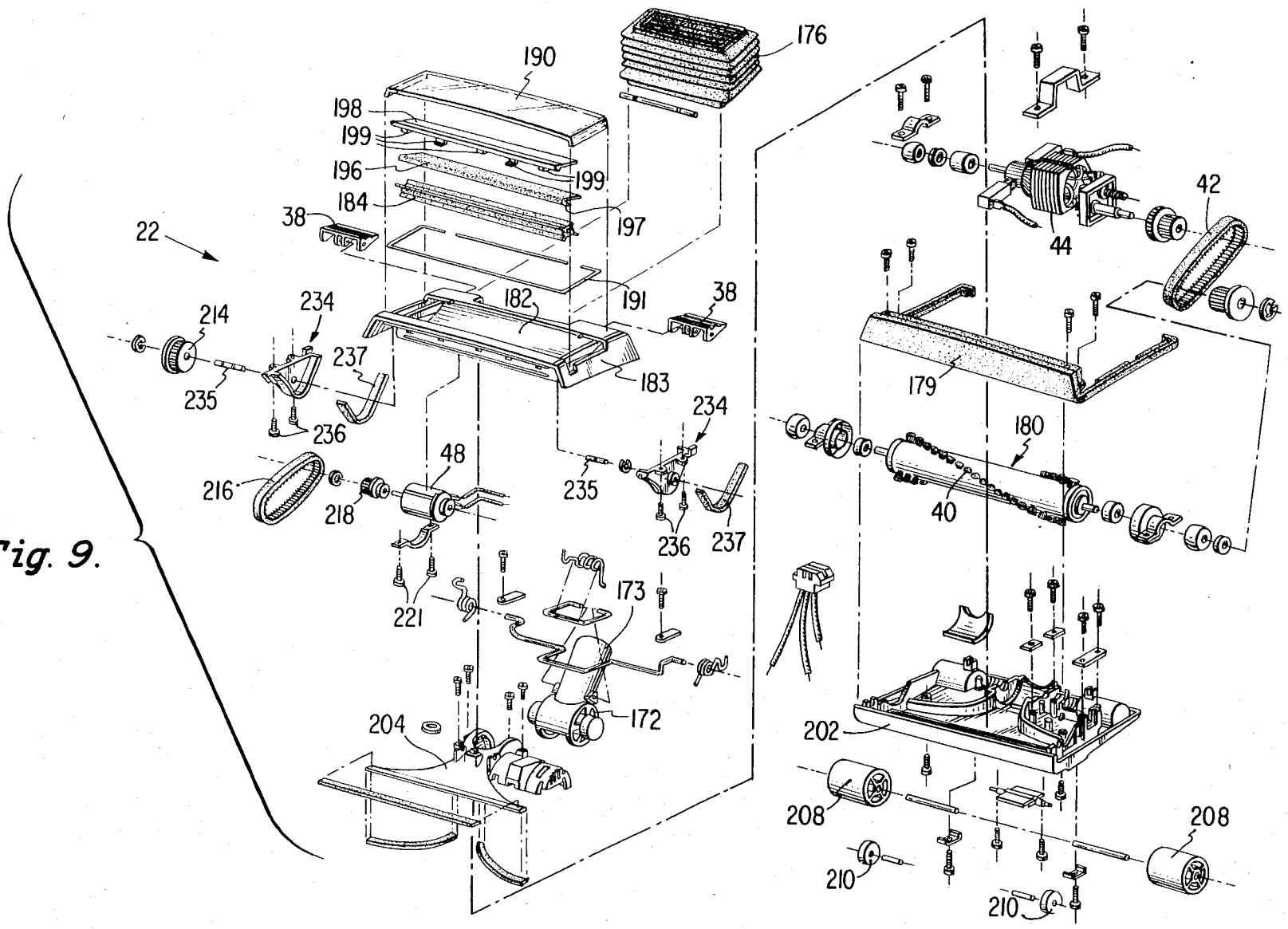
FIG. 9 is an exploded perspective of the floor care unit to show the internal construction thereof.

Referring to FIGS. 8 and 9 there are shown, respectively, exploded isometric views of the body 24 of the floor care appliance and of the floor unit 22 thereof which provide greater component detail and may be referred to to aid in understanding the construction of the floor care appliance 20. Referring to FIG. 8, there is noted the handle tube assembly 32 and the motor blower assembly 28 and the cover half 52 and main housing 54 including the motor baffle 144 and cover baffle 146. The cover half 52 is seen to include the switch assembly 30 which extends through the top 53 thereof. The rearwardly open cavity 90 of the motor housing 54 is seen to include a centrally located groove 224 (see also FIG. 4) arranged to accommodate a wiring harness 226 extending from the upper portion of the main housing 54 to the bottom of the main housing extension 154 in the groove between the cover 52 and the main housing 54. The wiring harness 226 ends in a connector 227 which is connected to a corresponding connector 231 in the floor unit 22, for dissemination of power to the various components supported in the floor unit. The line cord 36 may be connected to the wiring harness 226 to convey incoming power first to the floor unit 22 so that separation of the connectors 227, 231 will cut-off power both to the body of the floor care appliance and to the floor unit.

In FIG. 9, there is shown an exploded perspective of the floor unit 22 including the bellows 176 which extend between the floor unit and the body 24 of the floor care appliance. In this assembly, it will be noted that the first motor 44 is supported on the lower housing 202 while the second motor 48 is supported by the upper housing 183. The powder dispensing roll 184 is supported between end cap assemblies 234 on stub shafts 235, the end cap assemblies being affixed to the upper housing by screws 236 taking care to use seals 237 to insure that air tight connections are maintained to inhibit evaporation of the solvents in the dry chemical carpet cleaning powder.

Figure 12:
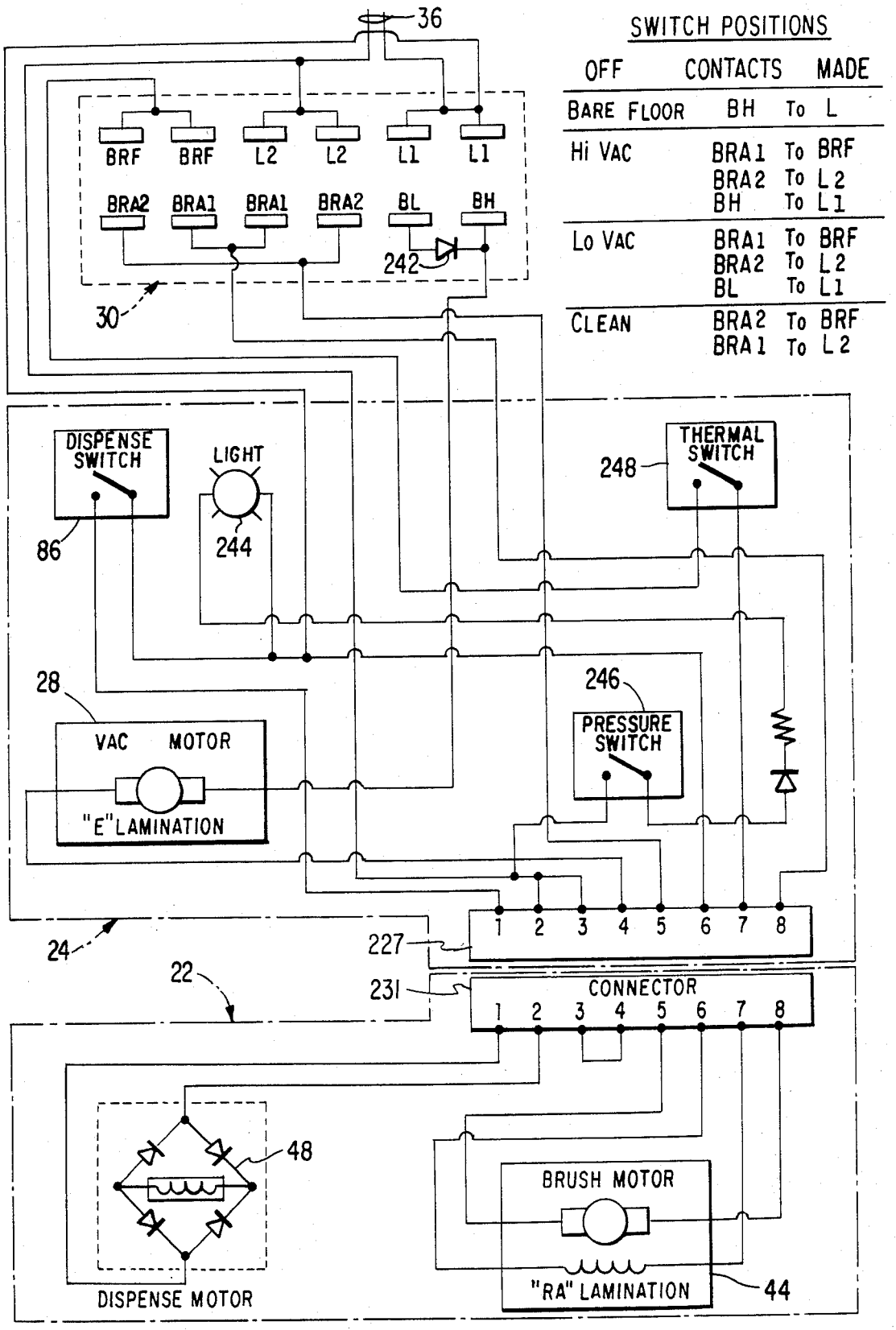
FIG. 12 is an electrical schematic for the floor care appliance.

Referring now to FIG. 12, there is disclosed a electrical schematic for the floor care appliance showing in separate dashed blocks that portion found in the body 24 of the floor care appliance and the floor unit 22 thereof. The electrical connection between the body 24 of the floor care appliance and the floor unit 22 is implemented by connectors 227, 231 (see also FIGS. 8 and 9). Power is brought into the floor appliance via the line cord 36 to the switch assembly 30. In the inset to FIG. 12, there are shown the connections made by the switch assembly 30 according to the mode of operation desired. Thus, for "bare floor" cleaning, contacts designated BH and L1 are connected so as to apply power to the motor of the motor blower assembly 28 but not to the first motor 44 for the brush 180 or to the second motor 48 for the powder dispending roll 184. In this mode of operation dust and dirt is conveyed to the filter arrangement 26 without the aid of the floor brush 180. In the "Hi Vac" mode of operation, the motor for the motor blower assembly 28 is activated, as is the first motor 44 for the brush 180 in a direction to urge dust and dirt from a carpet into the plenum chamber 50 of the floor unit 22. In the "Lo Vac" mode of operation, the contact L1 is connected to the contact BL so as to provide half wave rectification by means of diode 242, to thereby provide for a reduced speed of the motor for the motor blower assembly 28, providing a reduced vacuum therefrom. The other connections are the same as in the "Hi Vac" mode of operation. In the "Clean" mode of operation, the direction of rotation of the first motor 44, rotating the brush 181 is reversed by reversing the connections in the switch assembly 30. In this mode of operation, the momentary contact dispense switch 86 may be activated by depression of the dispense button 34 of FIG. 3 to rotate the powder dispensing roll 184 for dissemination of the dry chemical carpet cleaning powder onto the carpet. A light 244 is provided which is activated when a normally open pressure switch 246 situated in the lower diffuser 104 responds to high pressure indicative of an obstruction or fullness in the filter arrangement 26 to close the pressure switch 246. A thermal overload 248 is implemented by a normally closed bimetallic spring which responds to a current and temperature rise occasioned by a load on the first motor 44 for the brush 180 to curtail operation of the same until the overload condition is alleviated and the device manually reset by depression of button 249 in FIGS. 1 and 2.

While the invention has been described, disclosed, illustrated and shown in terms of a preferred embodiment, or modification which it has assumed in practice and here been described, disclosed, illustrated and shown, such other embodiments or modifications as may be suggested to those having the benefit of the teaching herein are intended to be reserved especially as they fall within the scope and breadth of the claims here appended.

We claim:

1. A floor care appliance comprising:

a main housing including integral top, rear and side panels, and further including a large rearwardly open cavity portion extending inwardly between said sides from said rear panel, said cavity portion including an inlet aperture thereto;

a handle for directing said floor care appliance;

means for attaching one end of said handle to an upper portion of said main housing;

a filter arrangement received in said main housing cavity portion, said filter arrangement including a filter bag carried within said cavity portion and an air permeable closure attached to said rear panel and covering said rearwardly open cavity portion;

an internal groove in said main housing beneath said cavity portion; a main housing motor baffle situated in said groove, a motor blower assembly supported by said main housing and said baffle below said cavity portion, said motor blower assembly including an inlet tube extending beyond a lower portion of said main housing and an outlet tube extending through said inlet aperture of said cavity portion to communicate with said filter bag, said main housing further including inlet louvers situated between said cavity portion and said internal groove;

a main housing extension having side panels and a rear panel, said rear panel having louvers therein;

means for attaching said main housing extension to said main housing at the bottom edge thereof;

a cover including integral top, front and side panels and an internal groove spaced from an end thereof;

a cover motor blower baffle captured in said cover internal groove;

means for affixing said cover to said main housing and said main housing extension with said motor blower baffles aligned and extending to said motor blower assembly to provide an inlet chamber for motor cooling air between said cavity portion and said motor baffles and an outlet chamber therefor open to the ambient through said louvers in said main housing extension;

a floor unit including a lower housing supporting a pair of rear wheels, a forwardly situated brush, and a reversible first motor for selectively driving said brush in a selected forward or reverse direction, an upper housing having a chamber for retaining a supply of carpet cleaning powder and supporting a second motor and means for selectively dispensing the powder operatively connected to said second motor, said lower housing further supporting a swivel having an outlet tube for connection to said inlet tube of said motor blower assembly, said swivel fitting communicating with a plenum chamber formed between said upper and lower housing and terminating in a slot adjacent said forwardly situated brush thereof which rotates toward said plenum chamber in said forward direction;

said cover including a switch assembly for selecting operation of said motor blower assembly without operation of said first motor, or operation of said motor blower assembly with operation of said first motor, or operation of said first motor in a reverse direction without operation of said motor blower assembly.

2. A floor care appliance as claimed in claim 1 further comprising switch means for selectively initiating operation of said second motor only during said operation of said first motor in a reverse direction for dispensing said carpet cleaning powder on a carpet for agitation by said brush being driven in a reverse direction.

3. A floor car appliance as claimed in claim 1, wherein said cover lies contiguous said cavity portion, said appliance further comprising a groove in the outer contiguous surface of said cavity portion extending from said upper portion to said lower portion of said main housing, and a wiring harness lying in said groove and extending from said switch assembly to said lower portion of said main housing.

* * * * *